United States Patent [19]

Mayes

[11] 4,136,677

[45] Jan. 30, 1979

[54] GUARD FOR OPEN FIREPLACE

[76] Inventor: C. C. Mayes, P.O. Box 8, Pigeon Forge, Tenn. 37863

[21] Appl. No.: 813,865

[22] Filed: Jul. 8, 1977

[51] Int. Cl.[2] ..... F24B 13/00; F24B 7/00

[52] U.S. Cl. ..... 126/298; 126/164; 126/201

[58] Field of Search ..... 126/298, 201, 202, 203, 126/336, 164, 153 B, 138, 139, 140, 141, 120

[56] References Cited

U.S. PATENT DOCUMENTS

| | | | |
|---|---|---|---|
| 413,548 | 10/1889 | Pitts | 126/202 |
| 969,953 | 9/1910 | Heller et al. | 126/298 |
| 2,057,659 | 10/1936 | Daniel | 126/298 |

*Primary Examiner*—Dennis L. Taylor
*Attorney, Agent, or Firm*—Fitch, Even, Tabin & Luedeka

[57] ABSTRACT

An andiron system is provided for use within a fireplace comprising a floor, a pair of oppositely disposed side walls, a front wall defining an opening and a rear wall disposed opposite said front wall. The andiron system comprises a pair of spaced apart andirons, and a guard. Each andiron comprises an elevated, generally horizontal log supporting member spaced vertically above and apart from the floor and extending from a location adjacent the front opening toward the rear wall and a post member extending generally uprightly from the supporting member adjacent the front opening of the fireplace. The guard comprises an elongated rigid rod having a length greater than the distance between the andiron post member and a pair of spaced apart cuff means fixedly secured to the rod. Each cuff defines an opening adapted to nonpivotably receive one of the post members. The rigid rod extends between the andirons in a position generally parallel to the front wall and the floor and above the log supporting members. Logs placed upon the log supporting members are restrained from rolling off the andirons toward the front opening and the andirons are restrained against movement relative to one another.

3 Claims, 5 Drawing Figures

GUARD FOR OPEN FIREPLACE

The present invention relates generally to the field of fireplaces, and like fire containing enclosures and more specifically to a system for holding logs in positions elevated above a fireplace floor.

In the field of fireplaces, it is common to provide within the fireplace a pair of spaced apart and unconnected andirons, each of which includes a generally horizontal member, the horizontal members of the two andirons being arranged in a parallel manner. Logs, which are essentially rigid, are piled upon the andirons for burning, supported by only the horizontal members. That is to say, the log end sections are supported while their middle sections are unsupported. This arrangement allows substantially unrestricted air flow to the underside of the burning log pile, thus promoting their combustion. Thereafter, because fire naturally concentrates at the center rather than at the edges of the pile, the fire consequently burns through the center sections of logs before the end sections burn. The logs then break at the centers. As noted above, each end section of a log is supported at only one location. Thus, when a log breaks at the center, the end sections move to assume a new stable position. Frequently, and particularly when several logs are involved, there is a significant amount of adjusting of the log pile and end portions of burning logs often roll from the support members onto the fireplace floor. This location for burning logs is undesirable because it has been found that logs burn more efficiently when they are retained in close proximity, particularly in contact with one another, and there is free air contact. In addition, pieces of logs can roll out of the fireplace and into the living area of the house, with resultant damage by fire and/or smoke.

A second problem frequently encountered with andirons arises because they are independently movable within the fireplace. Independently movable andirons are quite useful when ashes are being removed because each andiron can be easily moved entirely out of the way. However, as one places a large log upon a pair of andirons, it is not desirable for them to move, especially relative to one another, which frequently happens. Such relative motion also happens when logs burn and break at their centers. This motion adds to the amount of adjustment discussed above and increases the possibility that a burning log section will roll from the fireplace.

It is thus an object of the present invention to provide an improved andiron system. An additional object is to provide a unitary andiron system which restrains logs from rolling onto the fireplace floor and out of the fireplace while allowing a maximum area of air contact with the logs. A further object is to provide an andiron system in which the members supporting the logs are releasably fixed relative to one another. Further objects and advantages will become apparent through reference to the description and accompanying drawings in which.

Figure 1:
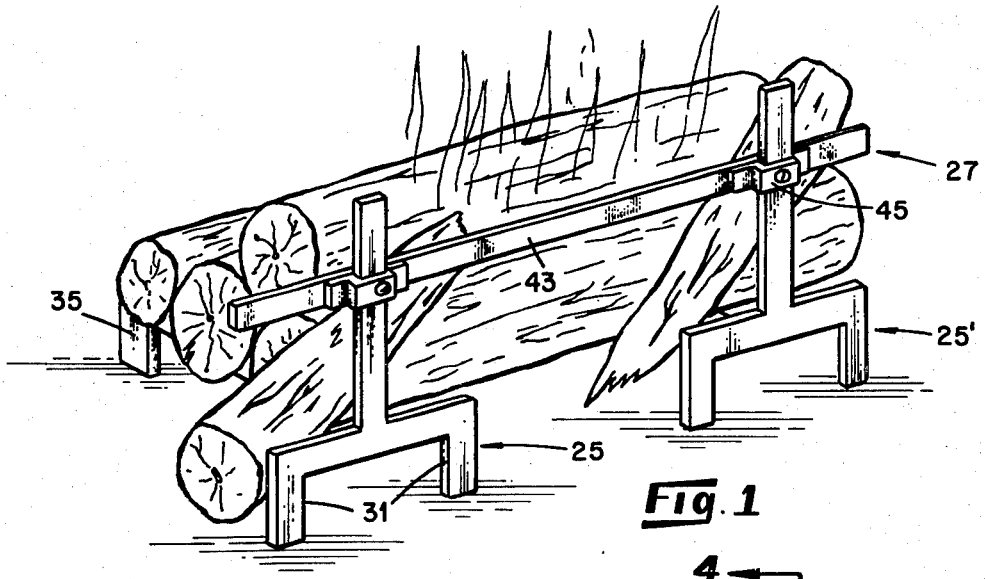
FIG. 1 is a perspective view of a system embodying various of the features of the presently disclosed system.
Figure 2:
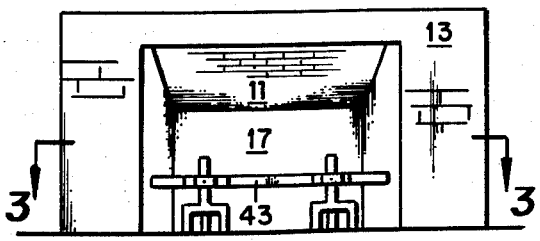
FIG. 2 is a plan view of a fireplace embodying various aspects of the presently disclosed system.

Generally, the disclosed andiron system includes, in combination with a fireplace, a pair of spaced apart andirons supported above the floor of a fireplace, each of which includes a horizontal log supporting member having an upper surface spaced above the fireplace floor and extending from the front opening of the fireplace toward the rear of the fireplace, a post member extending generally vertically upwardly from the support member, and a log guard comprising an elongated rigid rod and spaced apart cuff means fixedly attached to the rod and adapted to nonpivotally receive the post members, the rod extending between the andirons in a substantially horizontal position above the horizontal plane of the support members and rigidifying the andirons relative to one another and restraining logs from rolling off the andirons.

Referring to the drawings, there is depicted a fireplace 11 comprising a front wall 13 defining a front opening 15, a rear wall 17, a floor 19 and a pair of oppositely disposed side walls 21 and 23.

Disposed within the fireplace 11 is an andiron system comprising a pair of andirons 25 and 25', and a guard 27. Because the andirons are substantially identical, and perform identical functions only one will be described in detail. The depicted andiron 25 comprises a rigid, horizontal, elongated log supporting member 29 maintained in an elevated position relative to the floor 19 (preferably about 15 cm) by a pair of legs 31 at a first end 33 and a third leg 35 at the end 37 opposing the first end 33. Extending vertically upwardly from the first end 33 of the support member 29 is an elongated rigid post member 39. The post member 39 is non-circular, preferably rectangular, in cross-section and extends at least about 15 cm above the upper surface of the support member 29.

The depicted guard 27 comprises an elongated rigid rod 43, preferably steel, having a generally rectangular cross-section of about 0.6 cm by 1.2 cm. Fixedly secured to the rod 43 are a pair of spaced-apart cuff means 45 defining elongated openings 47. The openings 47 are adapted to slidably receive therethrough the post members 39 of the andirons 25 and 25' as the andirons rest upon the fireplace floor with their respective support members being parallel and spaced apart a distance less than the typical length of a log. The openings 47 are preferably rectangular in cross-section and only slightly larger than the post members 29 to allow sliding, but nonpivotal, receipt of the post members through the cuffs, thereby rigidifying the andirons relative to one another in their preselected spaced apart positions.

Figure 5:
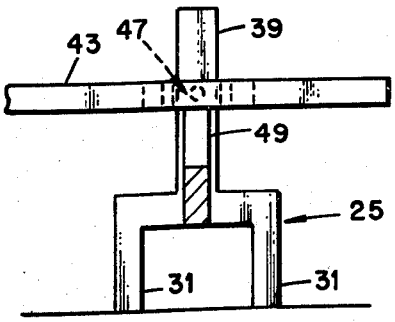
FIG. 5 is a plan view, partly in section, taken along line 5—5 in FIG. 4.
Figure 4:
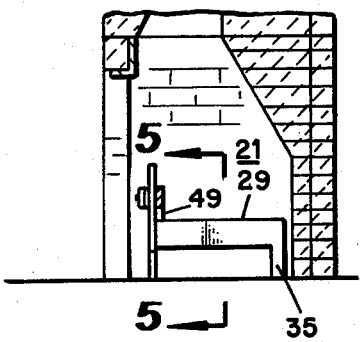
FIG. 4 is a plan view, partly in section, taken along line 4—4 in FIG. 3.

As shown in FIG. 5, extending downwardly from the cuff 45 is a rigid spacing means 49 which engages the upper surface 41 of the support member 29. The spacing means 49 ensures that the rod 43 slides no lower than a predetermined distance above the support member, preferably about 15 cm.

Figure 3:
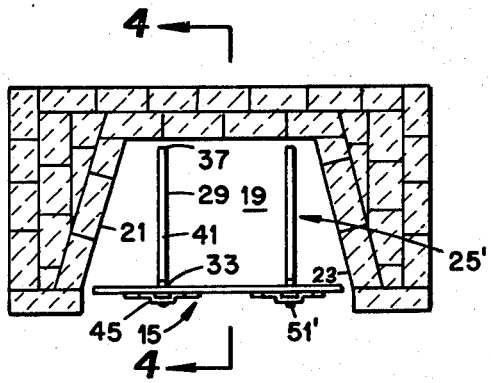
FIG. 3 is a plan view, partly in section, taken along line 3—3 in FIG. 2.

In the embodiment depicted in FIG. 3, included in the cuff means 45 is a threaded opening 50 (not shown) adapted to threadably receive a set screw 51 having a length sufficient to allow the screw to pass through the threaded opening and bear upon an inserted post member.

In use, two andirons 25 and 25' are inserted into a fireplace 11 and rest upon the floor 19 in positions in which the post members 37 and 37' are adjacent the opening 15 and the support members 29 and 29' extend horizontally and in an essentially parallel manner toward the rear wall 17. The support members 29 and 29' are spaced apart a distance suitable to support a plurality of logs or other combustible material in a stable manner. The cuff means 45 and 45' attached to the rod 43 are then slidably lowered onto the post members 39 and 39' until the desired level is reached, preferably when the spacing means 49 and 49' engages the support member 29 and 29'. The set screws 51 and 51' are then threadably inserted into the openings 50 and 50' until their leading ends 53 and 53' bear upon the posts 39 and 39' securing the rod 43 against vertical motion. Motion of the andirons relative to each other and to the guard 27 is prohibited by the insertion of the posts into the cuffs, both the posts and cuffs having similar, non-circular cross-sections. The set screws 51 and 51' further rigidify the system so that the guard and andirons form a substantially unitary system. Logs are placed upon the support members 29 without the danger that the support members will shift or spread relative to each other.

After the logs have been ignited and burned for a while, resulting in changes in size, weight and strength, some logs merely shift, or even break, to overcome imbalances, and roll forward toward the opening. In fact, sometimes it is even desirable to intentionally shift the logs, such as when a new log is added or to bring the logs into greater contact with one another. The guard 27 restrains logs from rolling forwardly of the fireplace beyond the post members 39. Thus, the logs stay closer together for more efficient burning and are restrained from falling out of the fireplace. For greater security, the rod 43 extends outwardly from the post members 39 toward the side walls 21 and 23 to ensure that unburned log ends do not roll or tumble out of the fireplace front opening. In this instance, the rod 43 has a length dimension that is generally equal to the width dimension of the front opening of the fireplace.

The releasable attachment of the guard to the posts allows for easy dismantling and removal of the system from the fireplace during ash removal, etc. In the event the guard is damaged by heat, it is readily removable for replacement without replacing the entire system.

The disclosed system provides an economical apparatus for reducing the risk of fire damage to the building interior without reducing the rate of burning. It also enhances the ease of placing and adjusting logs within the fireplace.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. In a fireplace comprising a floor, a pair of oppositely disposed side walls, a front wall defining an opening and a rear wall disposed opposite said front wall, an andiron system comprising a pair of spaced apart andirons, each of said andirons comprising an elevated generally horizontal log supporting member spaced vertically above and apart from said floor and extending from a location adjacent said front opening toward said rear wall of said fireplace and a post member of non-circular cross section extending generally uprightly from said support member adjacent said front opening of said fireplace, and a log guard comprising a single elongated rigid rod having a length greater than the distance between said andiron post members whereby the ends of said rod project laterally from said post members to extend substantially across the said opening of said fireplace, a pair of spaced apart cuff means fixedly secured to said rod and each defining an opening that is complementary in geometry to said non-circular cross section of said post member and non-pivotably receiving one of said post members, and means supporting said rigid rod substantially horizontally between said andirons in a position generally parallel to said front wall and said floor and above said log supporting member with no substantial portion thereof being disposed below said log supporting members to block said fireplace opening, whereby logs placed upon said log supporting members are restrained from rolling off said andirons in a direction toward said front opening of said fireplace and said andirons are restrained against pivotal movement relative to one another and pantographic-type movement of said andirons and said rod.

2. A system as described in claim 1 wherein said cuff means includes rigid spacing means depending from said cuff means and engaging said andiron, whereby said rod is supported in a position spaced above said support members.

3. A system as described in claim 1 including means releasably securing each of said cuff means to said posts.

* * * * *